US008196705B2

(12) United States Patent
Jejina

(10) Patent No.: US 8,196,705 B2
(45) Date of Patent: Jun. 12, 2012

(54) SAFETY SCAFFOLDING

(76) Inventor: Mark Jejina, Innisfail (CA)

( * ) Notice: Subject to any disclaimer, the term of this patent is extended or adjusted under 35 U.S.C. 154(b) by 332 days.

(21) Appl. No.: 12/399,652

(22) Filed: Mar. 6, 2009

(65) Prior Publication Data

US 2009/0223743 A1 Sep. 10, 2009

(51) Int. Cl.
*E04G 3/30* (2006.01)

(52) U.S. Cl. ..... 182/150; 182/82

(58) Field of Classification Search ..... 182/82, 182/150

See application file for complete search history.

(56) References Cited

U.S. PATENT DOCUMENTS

| | | | | |
|---|---|---|---|---|
| 3,134,567 | A | 5/1964 | Shoemaker | |
| 3,510,097 | A | 5/1970 | McCaleb | |
| 3,515,244 | A | 6/1970 | Baines | |
| 3,595,510 | A | 7/1971 | Hutchinson | |
| 3,798,856 | A | 3/1974 | Gloskowski | |
| 4,396,092 | A * | 8/1983 | Thompson | 182/38 |
| 4,872,634 | A * | 10/1989 | Gillaspy et al. | 248/354.3 |
| 4,971,169 | A | 11/1990 | Fruth | |
| D313,583 | S | 1/1991 | Panyik | |
| 5,259,477 | A | 11/1993 | Fears et al. | |
| 5,441,125 | A * | 8/1995 | Cook | 182/82 |
| 5,503,358 | A | 4/1996 | Lapp | |
| 5,524,727 | A | 6/1996 | Yennie, Jr. | |
| 5,638,917 | A | 6/1997 | Vennen | |
| 5,829,549 | A * | 11/1998 | Flynn | 182/82 |
| 5,878,838 | A | 3/1999 | Lapp | |
| D413,681 | S | 9/1999 | Zumwalt | |
| 6,053,280 | A | 4/2000 | Smith et al. | |
| 6,666,298 | B2 | 12/2003 | Volkman | |
| D492,892 | S * | 7/2004 | Volkman | D8/373 |
| 6,886,662 | B2 * | 5/2005 | Riley | 182/82 |
| 2003/0139422 | A1 | 7/2003 | Teng | |
| 2005/0139422 | A1 | 6/2005 | Riley | |
| 2005/0199441 | A1 | 9/2005 | Thery | |
| 2006/0060738 | A1 | 3/2006 | Whittington et al. | |
| 2006/0163001 | A1 * | 7/2006 | Pozell | 182/82 |
| 2006/0175130 | A1 | 8/2006 | Riley | |
| 2006/0243524 | A1 | 11/2006 | Jarrell et al. | |
| 2007/0056799 | A1 | 3/2007 | Leidner et al. | |

FOREIGN PATENT DOCUMENTS

| | | |
|---|---|---|
| CA | 2209805 | 8/1997 |
| CA | 2359388 | 4/2003 |
| GB | 2090316 | 11/1980 |
| WO | 9820215 | 5/1998 |

* cited by examiner

*Primary Examiner* — Blair M. Johnson
(74) *Attorney, Agent, or Firm* — Bennett Jones LLP

(57) ABSTRACT

The invention is directed to a suspended scaffolding apparatus mountable on wall for supporting a scaffold platform. The scaffolding apparatus includes at least attachment brackets, at least two vertical frame members, at least two support brackets, one or more braces and at least two detachable railing posts. The vertical frame members and associated support brackets may be selectively attached and detached from the attachment brackets which remain mounted on the top surface of the wall. The scaffolding apparatus can thus be conveniently installed at any time to permit work on the roof of the building.

17 Claims, 7 Drawing Sheets

SAFETY SCAFFOLDING

FIELD OF THE INVENTION

The present invention relates to a scaffolding apparatus, and in particular to a scaffolding apparatus for use during the construction of a building.

BACKGROUND OF THE INVENTION

During the construction of a building there is a frequent need to use scaffolding to permit workers to engage in construction activities at various levels above the ground, especially so during the phase of construction in which the roof and associated elements are constructed. The use of conventional scaffolding for such elevated activities is problematic for a number of reasons. Uneven or soft terrain can render conventional scaffolding unstable. Obstacles on the ground may impede the ability to construct conventional scaffolding. Conventional scaffolding is heavy and labour intensive to put up and down, particularly so when the required elevation is great. The use of ladders for elevated work presents the same challenges as conventional scaffolding and poses a serious safety risk to the workers.

There have been a number of suggested prior art inventions directed to hanging or suspended collapsible scaffolding systems made from light weight material. The systems employ catwalks and guardrails to comply with relevant safety regulations. In each such prior art system the scaffolding hangs from a mounting plate or hook straddling the top of a wall. The scaffolding is temporarily attached to the wall in this manner so that it can be easily moved during construction and detached upon completion of the construction. There is however, a significant disadvantage to such prior art systems. They all rely on brackets or hooks straddling the top of a wall which does not pose a problem during the process of active construction. However, once the soffit of a building is installed under the eaves, access to the top of the wall is blocked. Thus, as soon as the soffit is completely installed, such devices can no longer be used. This is particularly problematic for workers who must engage in repair or modification activities or repairs to an already completed building. A second disadvantage is that when the suspended scaffold is loaded with equipment and workers, a force is exerted on the wall which can cause it to shift from the desired perpendicular position. Some the prior art devices have associated bracing systems but they are unduly complex and bulky.

SUMMARY OF THE INVENTION

The present invention is directed to a suspended scaffolding apparatus. In one aspect, the invention provides a suspended scaffolding apparatus for use on a wall, the wall having a substantially horizontal top surface and two sides, each such side comprising a substantially vertical face, the scaffolding apparatus comprising:

(a) at least two attachment brackets mounted on the top surface of the wall;

(b) at least two vertical frame members, each such vertical frame member being adapted to releasably attach to an attachment bracket such that when it is attached to the attachment bracket, the vertical frame member extends downwards in an orientation that is substantially perpendicular to the top surface of the wall and substantially parallel to the face of the wall; and (c) at least two support brackets, each such support bracket having attachment elements to releasably attach to a vertical frame member such that when attached, the support bracket extends in a direction that is out and away from the face of the wall in an orientation that is substantially perpendicular to the vertical frame member and each such support bracket having a detachable railing post extending upwards in an orientation that is substantially parallel to the vertical frame member;

whereby the vertical frame members and associated support brackets may be selectively attached and detached from the attachment brackets which remain mounted on the top surface of the wall.

In one embodiment, the attachment brackets are adjustable to accommodate use of the apparatus with walls of differing sizes. In one embodiment, each attachment bracket is adapted to releasably engage a brace. In one embodiment, the brace is located on the side of the wall opposite to the vertical frame members and the associated support brackets. In one embodiment, the attachment bracket comprises:

(a) a first bracket member comprising:

(i) a horizontal top plate, the top plate being securely mounted to the top surface of the wall; and (ii) an interconnected first vertical plate extending in a direction down and away from the top of the wall in an orientation that is perpendicular to the horizontal top plate, the first vertical plate resting against one side of the wall in a substantially parallel manner; and either (iii) the horizontal top plate extending in a direction out and away from the side of the wall and having a first attachment to releasably attach a vertical frame member;

or (iv) the first vertical plate having a substantially perpendicular horizontal base extending in a direction out and away from the side of the wall that the first vertical plate rests against, the horizontal base having a second attachment to releasably attach a vertical frame member;

(b) a second bracket member comprising:

(i) a horizontal top plate, the top plate being adjustably mountable on the top plate of the first bracket member;

(ii) an interconnected second vertical plate, the second vertical plate extending in a direction down and away from the top of the wall in an orientation that is perpendicular to the horizontal top plate, the second vertical plate resting against the side of the wall opposite to the first vertical plate in a substantially parallel manner; and (iii) a third attachment for a brace.

In one embodiment, the top plate of the first bracket member defines a plurality of apertures for the insertion of connectors for mounting the first bracket member on the top of the wall. In one embodiment, the first attachment to releasably engage the vertical frame member comprises a threaded aperture in the horizontal top plate or the horizontal base of the first bracket member that complements a threaded projection on one end of the vertical frame member. In one embodiment, the second attachment to releasably engage the vertical frame member comprises an elongate slot in the horizontal top plate or the horizontal base of the first bracket member that complements a T-hook on one end of the vertical frame member. In one embodiment, the top plate of the second bracket member has a slot formed therein and is mounted to the top plate of the first bracket member by connectors extending through the slot to align with the apertures of the top plate of the first bracket member. In one embodiment, the third attachment for a brace comprises a bracing ring fixed to the top plate of the second bracket member.

In one embodiment, the vertical frame member comprises an elongate body having a plurality of openings for the attachment of a support bracket to the vertical frame member, a threaded projection at one end to releasably engage a threaded aperture in the attachment bracket or a T-hook at one end to releasably engage an elongate slot in the attachment bracket, and a spacer member extending outwardly in a substantially perpendicular orientation at the opposite end.

In one embodiment, the support bracket comprises a quadrilateral frame having at least two opposing frame portions and two opposing end portions, the opposing frame portions being connected by one or more crossbeams oriented parallel to the opposing end portions. In one embodiment, the first opposing end portion defines a plurality of bores through which connectors extend to align with the openings of the vertical frame member to releasably attach the support bracket to the vertical frame member. In one embodiment, the second opposing end portion provides connectors to releasably attach the railing post to the support bracket. In one embodiment, the connector comprises a tapered pin.

In one embodiment, the scaffolding apparatus further comprises a harness ring attached to the support bracket for threading of securing members.

In one embodiment, the railing post supports railing brackets for retaining boards and a harness ring for threading of securing members.

In one embodiment, the brace comprises an elongated body having a screw clevis at each end, one screw clevis being attached to the bracing ring of the second bracket member, and the other screw clevis being anchored to the floor by a floor bracket.

In one embodiment, the scaffolding apparatus further comprises a plug having a head and threaded neck for attachment to the threaded aperture, or a plug complementary for attachment to the elongate slot when the apparatus is not in use.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF THE INVENTION

The present invention provides for a suspended scaffolding apparatus. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

"Horizontal" means a plane that is substantially parallel to the plane of the horizon. "Vertical" means a plane that is perpendicular to the horizontal plane.

Figure 1:
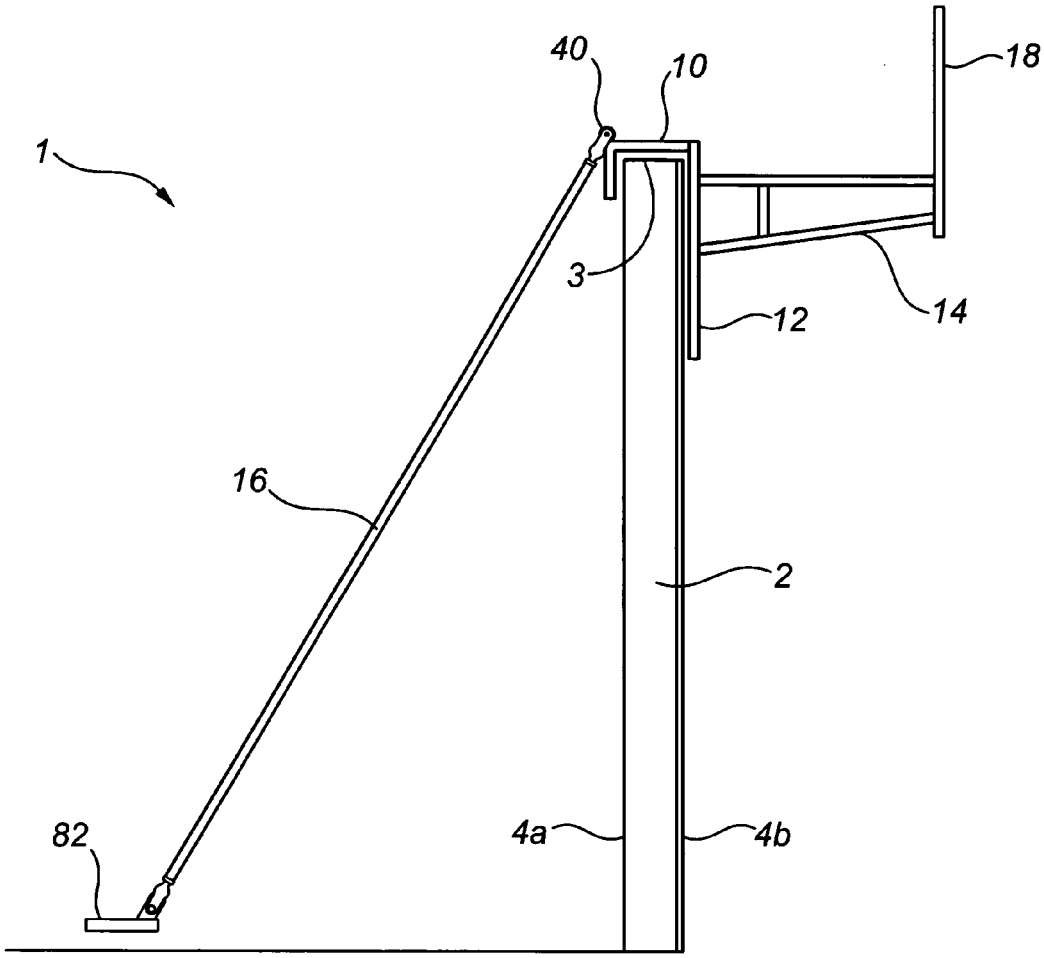
FIG. 1 is a diagrammatic representation of a side view of a scaffolding apparatus of one embodiment of the present invention installed on a wall.

In one embodiment, the scaffolding apparatus (1) is shown generally in FIG. 1 to include at least two attachment brackets (10), at least two vertical frame members (12), at least two support brackets (14), one or more braces (16) and at least two detachable railing posts (18). FIG. 1 shows the suspended scaffolding apparatus (1) mounted onto a wall (2) of a home or building. The wall (2) has a substantially horizontal top surface (3) and two sides having substantially vertical faces (4*a*, 4*b*). The attachment brackets (10) are mounted on the top surface (3) of the wall (2), and are adjustable to accommodate use of the scaffolding apparatus (1) with walls of differing sizes. In one embodiment, the wall (2) has a height ranging from eight to ten feet. In one embodiment, the wall (2) has a height greater than ten feet. Each attachment bracket (10) is adapted to releasably engage the brace (16) which is located on the side of the wall (2) opposite to the vertical frame members (12) and the associated support brackets (14). Simply for ease of description, each of the above features is described and illustrated singularly in FIGS. 2-7.

Figure 2:
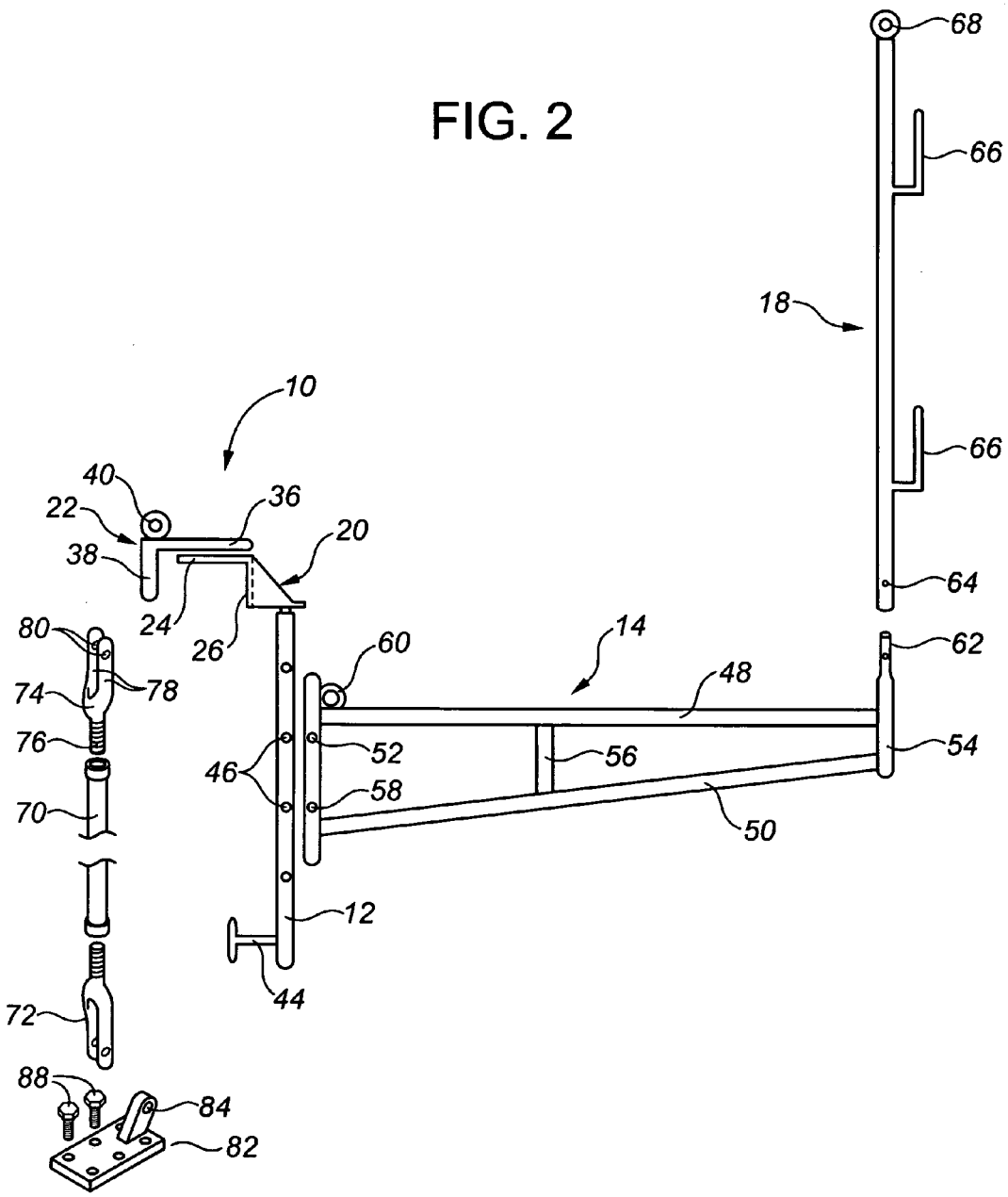
FIG. 2 is a diagrammatic representation of an exploded view of a scaffolding apparatus of one embodiment of the present invention.
Figure 3:
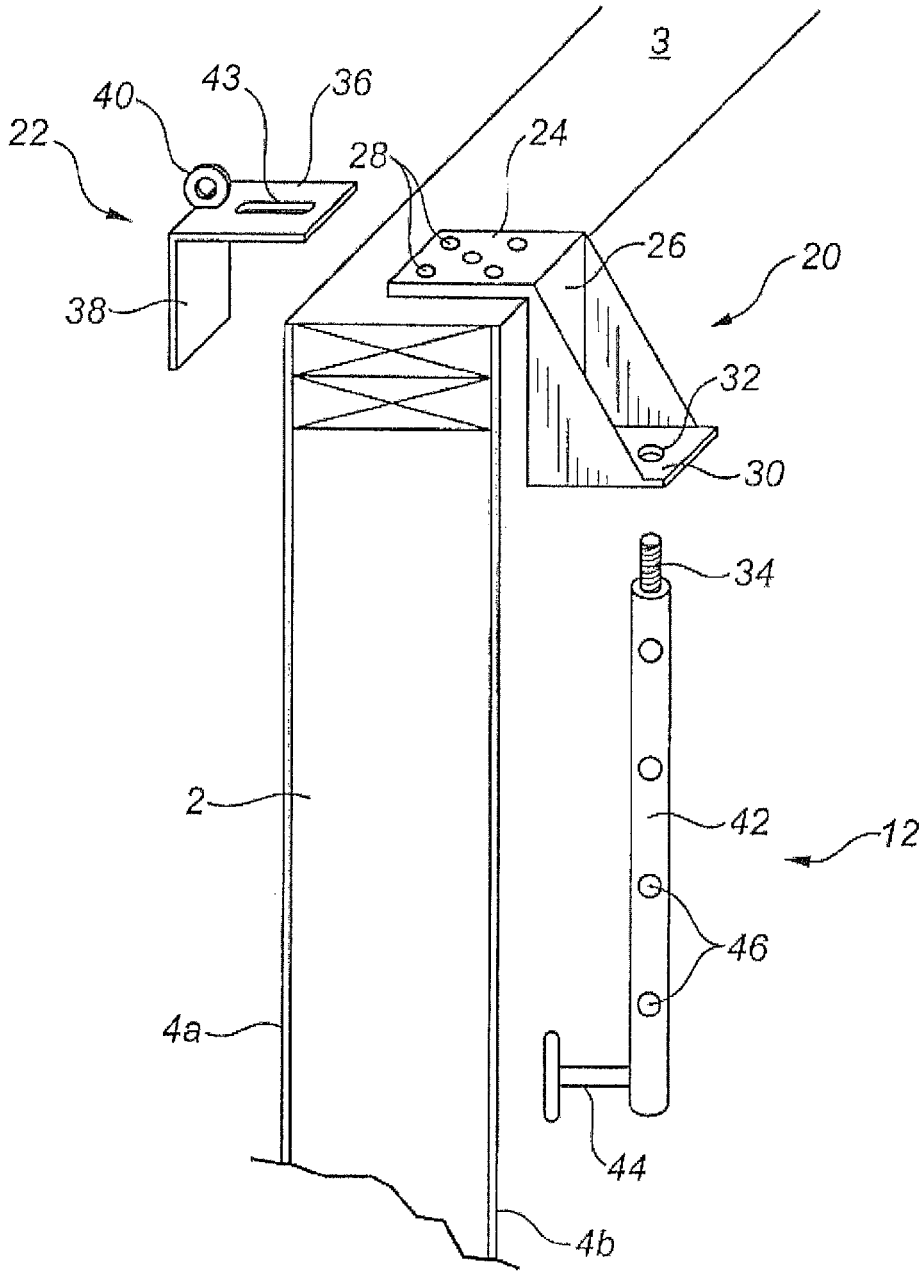
FIG. 3 is a diagrammatic representation of a side view of a portion of a scaffolding apparatus of one embodiment of the present invention.
Figure 3A:
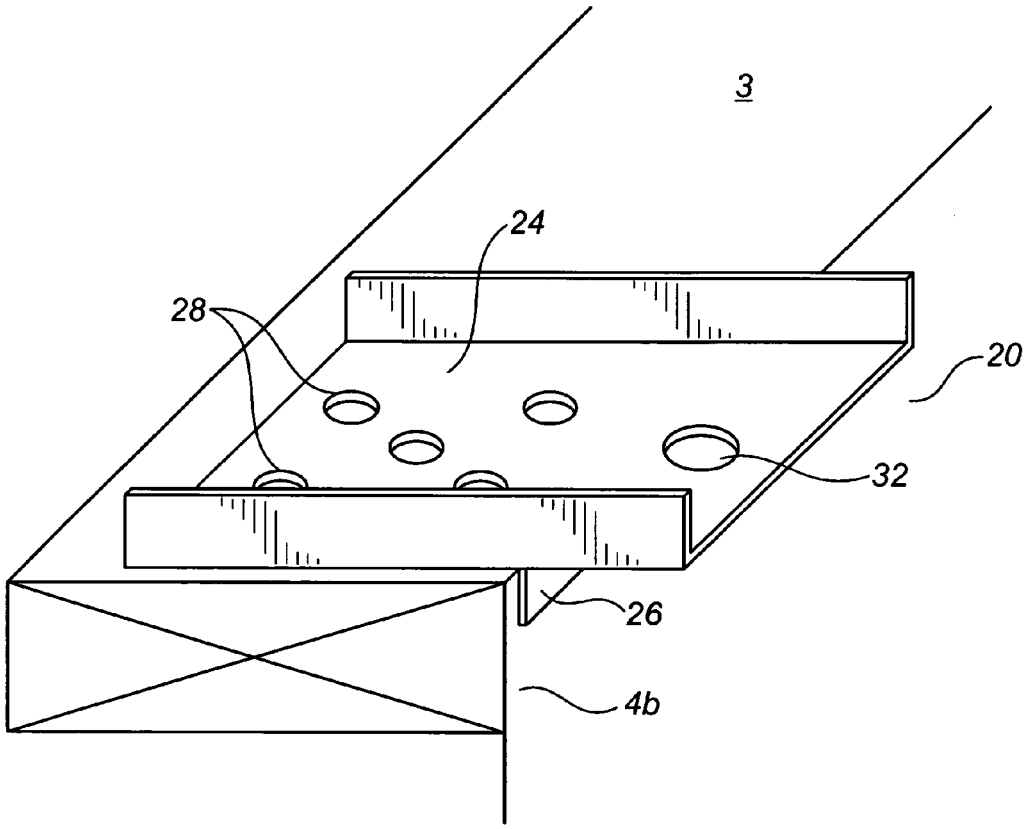
FIG. 3A is a diagrammatic representation of a side view of a first bracket member of a scaffolding apparatus of one embodiment of the present invention.
Figure 3B:
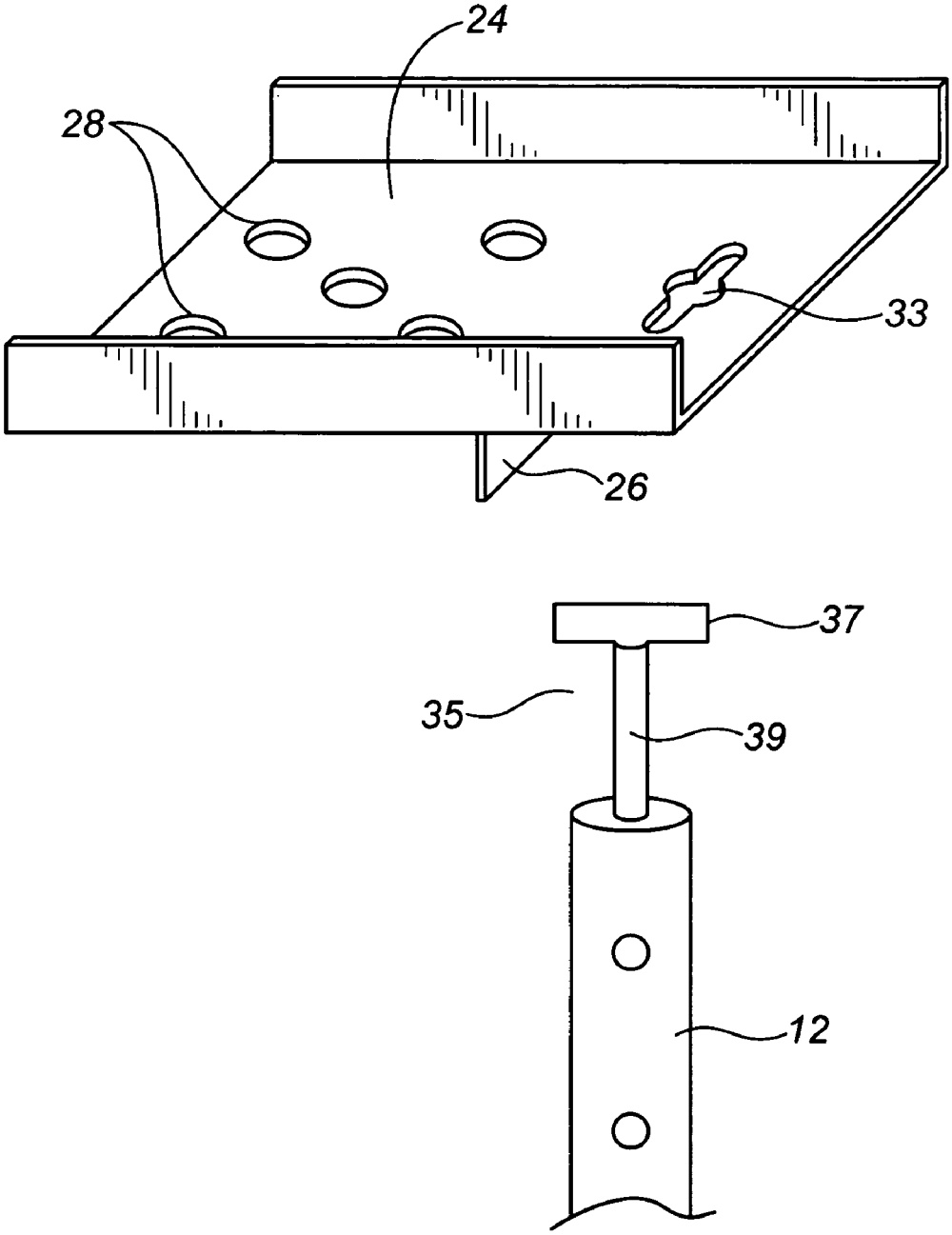
FIG. 3B is a diagrammatic representation of a side view of a first bracket member of a scaffolding apparatus of one embodiment of the present invention.
Figure 4:
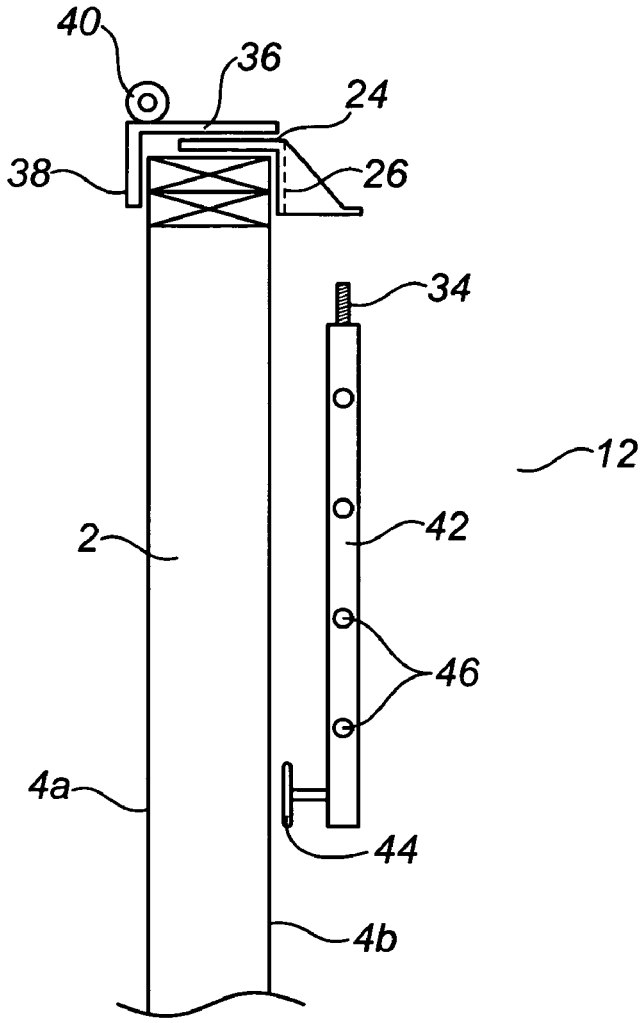
FIG. 4 is a diagrammatic representation of a side view of a portion of a scaffolding apparatus of one embodiment of the present invention.

FIG. 2 illustrates the attachment bracket (10), vertical frame member (12), support bracket (14), and detachable railing post (18) disassembled before installation on the wall (2). As shown in FIGS. 2 and 3, the attachment bracket (10) comprises first and second bracket members (20, 22). The first and second bracket members (20, 22) can be formed of any suitable material including, for example, metals such as aluminum or steel. The first bracket member (20) comprises a horizontal top plate (24) and an interconnected first vertical plate (26). The horizontal top plate (24) is securely mounted to the top surface (3) of the wall (2). In one embodiment, the horizontal top plate (24) has a plurality of apertures (28) for the insertion of connectors (for example, bolts) for securely mounting the first bracket member (20) on the top (3) of the wall (2). In one embodiment, the horizontal top plate (24) extends in a direction out and away from the side (4*b*) of the wall (2) (FIGS. 3A and 3B).

The first vertical plate (26) extends in a direction down and away from the top (3) of the wall (2) in an orientation that is perpendicular to the horizontal top plate (24). The first vertical plate (26) rests against one side (4*b*) of the wall (2) in a substantially parallel manner. In one embodiment, the first vertical plate (26) has a substantially perpendicular horizontal base (30) which extends in a direction out and away from the side (4*b*) of the wall (2) against which the first vertical plate (26) rests (FIG. 3). The horizontal top plate (24) as shown in FIGS. 3A and 3B, or the horizontal base (30) as shown in FIG. 3 has an attachment to releasably attach a vertical frame member (12). In one embodiment, the first attachment to releasably engage the vertical frame member (12) comprises a threaded aperture (32) in the horizontal top plate (24) (FIG. 3A) or in the horizontal base (30) (FIG. 3) which complements a threaded projection (34) on one end of the vertical frame member (12).

In one embodiment, the second attachment to releasably engage the vertical frame member (12) comprises an elongate slot (33) in the horizontal top plate (24) (FIG. 3B) or in the horizontal base (30) (not shown). In one embodiment, the slot (33) is a keyhole-type slot. The slot (33) allows for insertion, movement and retention of a corresponding T-hook (35) on one end of the vertical frame member (12) to secure the vertical frame member (12) to the horizontal top plate (24) or the horizontal base (30). The T-hook (35) has a head (37) and shaft (39). As can be seen from FIG. 3B, the T-hook (35) is preferably symmetric, i.e., the head (37) extends the same distance on both sides of the shaft (39). For assembly, the head (37) is aligned with the slot (33), inserted upwardly through the slot (33), and rotated 90 degrees so that the head (37) is perpendicular to the slot (33). The perpendicular alignment retains the T-hook (35) securely within the slot (33), thereby attaching the vertical frame member (12) to the horizontal top plate (24) or horizontal base (30).

The second bracket member (22) comprises a horizontal top plate (36), an interconnected second vertical plate (38), and a third attachment (40) for a brace (16). The horizontal top plate (36) is adjustably mountable on the horizontal top plate (24) of the first bracket member (20). The horizontal top plate (36) has a slot (43) formed therein, and is mounted to the horizontal top plate (24) of the first bracket member (20) by connectors (for example, bolts) which extend through the slot (43) to align with the apertures (28) of the horizontal top plate (24) of the first bracket member (20).

The second vertical plate (38) extends in a direction down and away from the top (3) of the wall (2) in an orientation that is perpendicular to the horizontal top plate (36). The second vertical plate (38) rests against the side (4*a*) of the wall (2) opposite to the first vertical plate (26) in a substantially parallel manner. In one embodiment, the third attachment (40) for the brace (16) comprises a bracing ring fixed to the horizontal top plate (36) of the second bracket member (22). The bracing ring enables the threading of securing members (for example, a cable or chain) for releasably engaging the brace (16).

The vertical frame member (12) comprises an elongate body (42), the threaded projection (34) or the T-hook (35), and a spacer member (44). The elongate body (42) has a plurality of openings (46) for the attachment of a support bracket (14) to the vertical frame member (12). In one embodiment, the threaded projection (34) at one end releasably engages the threaded aperture (32) in the attachment bracket (10). In one embodiment, the T-hook (35) at one end releasably engages the elongate slot (33) in the attachment bracket (10). The spacer member (44) extends outwardly in a substantially perpendicular orientation at the opposite end, and cushions the outer face (4*b*) from other components (i.e., preventing damage) as the vertical frame member (12) is installed. The length of the spacer member (44) may be adjusted accordingly so as to ensure contact of the spacer member (44) with the outer face (4*b*), and to facilitate leveling of the support bracket (14) in parallel with the wall (2).

The elongate body (42), the threaded projection (34), and the T-hook (35) can be formed of any suitable material including, for example, metals such as aluminum and steel. The spacer member (44) can be constructed of rubber, foam, plastic or other material. Preferably the material is chosen not to damage the wall and to prevent slippage. When attached, the vertical frame member (12) extends downwards in an orientation which is substantially perpendicular to the top surface (3) of the wall (2), and substantially parallel to the outer face (4*b*) of the wall (2).

As shown in FIG. 2, the support bracket (14) comprises a quadrilateral frame having at least two opposing frame portions (48, 50) and two opposing end portions (52, 54). The opposing frame portions (48, 50) are connected and reinforced by one or more crossbeams (56) which are oriented parallel to the opposing end portions (52, 54). The support bracket (14) can be formed of any suitable material, although for strength and to withstand cold and adverse outdoor conditions, the support bracket (14) may be formed of metal, for example, aluminum or steel. In one embodiment, the support bracket (14) is constructed of 1¼ inch pipe.

The first opposing end portion (52) defines a plurality of bores (58) through which suitable connectors (for example, bolts and screws) extend to align with the openings (46) of the vertical frame member (12) to releasably attach the support bracket (14) to the vertical frame member (12). When attached, the support bracket (14) extends in a direction that is out and away from the face (4*b*) of the wall (2) in an orientation that is substantially perpendicular to the vertical frame member (12). Provision of a plurality of openings (46) and bores (58) allows the vertical positioning of the support brackets (14), hence the height of the scaffold platform supported thereon, to be readily adjusted as required. Following use, the vertical frame members (12) and associated support brackets (14) may be selectively attached and detached from the attachment brackets (10) which remain mounted on the top surface (3) of the wall (2).

The support bracket (14) includes a harness ring (60) through which securing members (for example, cables, chains, ropes, slings or straps) may be threaded for attachment to a workman's harness, providing fall protection while the workman is standing upon the scaffold platform (not shown).

The second opposing end portion (54) provides connectors to releasably attach the detachable railing post (18) to the support bracket (14). In one embodiment, the connector comprises a tapered pin (62) which protrudes from the second opposing end portion (54). The railing post (18) is adapted to fit over the tapered pin (62) and be bolted thereto by suitable connectors (for example, bolts and screws) extending through bolt holes (64). When attached, the railing post (18) extends upwards in an orientation that is substantially parallel to the vertical frame member (12).

The railing post (18) supports railing brackets (66) for retaining boards (not shown) to bar a fall, and a harness ring (68) for threading of securing members (for example, cables, chains, ropes, slings or straps) to be attached to a workman's harness to provide additional fall protection while the workman is standing upon the scaffold platform (not shown). The railing post (18) and railing brackets (66) can be constructed of any suitable material including, for example, metals such as aluminum or steel. In one embodiment, the railing post (18) supports one railing bracket (66) to encase one board. In one embodiment, the railing post (18) supports more than one railing bracket (66) to facilitate stacking of multiple, adjacent boards. In one embodiment, the railing bracket (66) includes connectors for securing the boards. In one embodiment, the connectors are screws. In one embodiment, the boards may be single 2×4 boards or may be constructed of other materials as are commonly used in the art.

When installed, at least two support brackets (14) are spaced apart longitudinally at a distance sufficient to accommodate the scaffold platform (not shown). The platform can be constructed of any suitable material including, for example, aluminum, steel or wood. Workmen are generally prohibited from working on platforms covered with snow, ice or accumulated debris except to remove the hazard. The platform can be grated or comprise a metal floor grille or lattice to provide a slip-resistant surface, improving tread grip and safety during normal or adverse outdoor conditions.

The brace (16) comprises an elongated body (70) having a conventional screw clevis (72) at each end (FIG. 2). The brace (16) can be formed of aluminum, steel or other suitable materials. The screw clevis (72) can be formed of any suitable material including, for example, metals such as aluminum and steel. Each screw clevis (72) is generally U-shaped, having a bow portion (74) with a threaded shank (76), and arms (78) with eyelets (80) for insertion of attachment elements. During installation, the brace (16) is pivotally attached to both the attachment bracket (10) and floor (5) so as to be moveable into an appropriate position for leveling the wall (2) and supporting weight safely on the scaffolding apparatus (1) (FIG. 1). When installed, the brace (16) extends out and away from the inner face (4*a*) of the wall (2) in an orientation that is diagonal to the floor (5).

Figure 6:
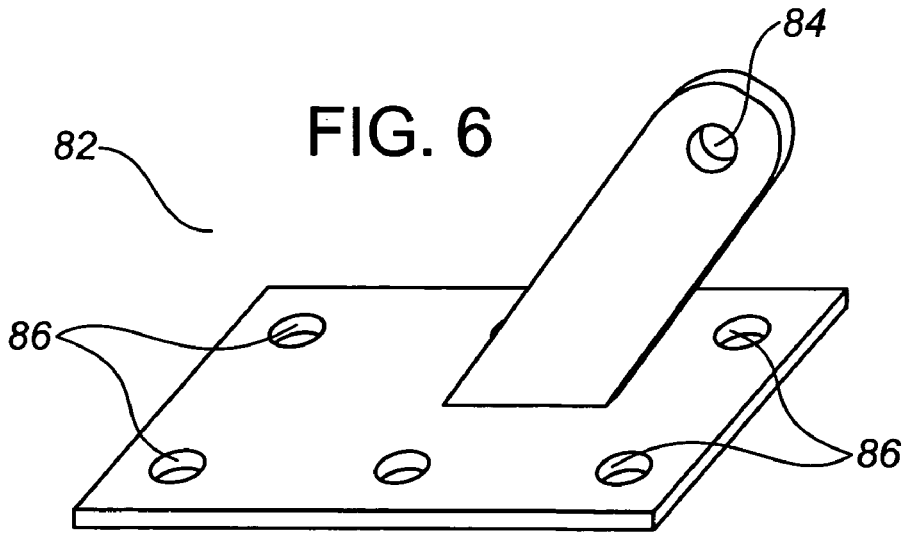
FIG. 6 is a diagrammatic representation of a perspective view of a floor bracket of FIG. 2.
Figure 7:
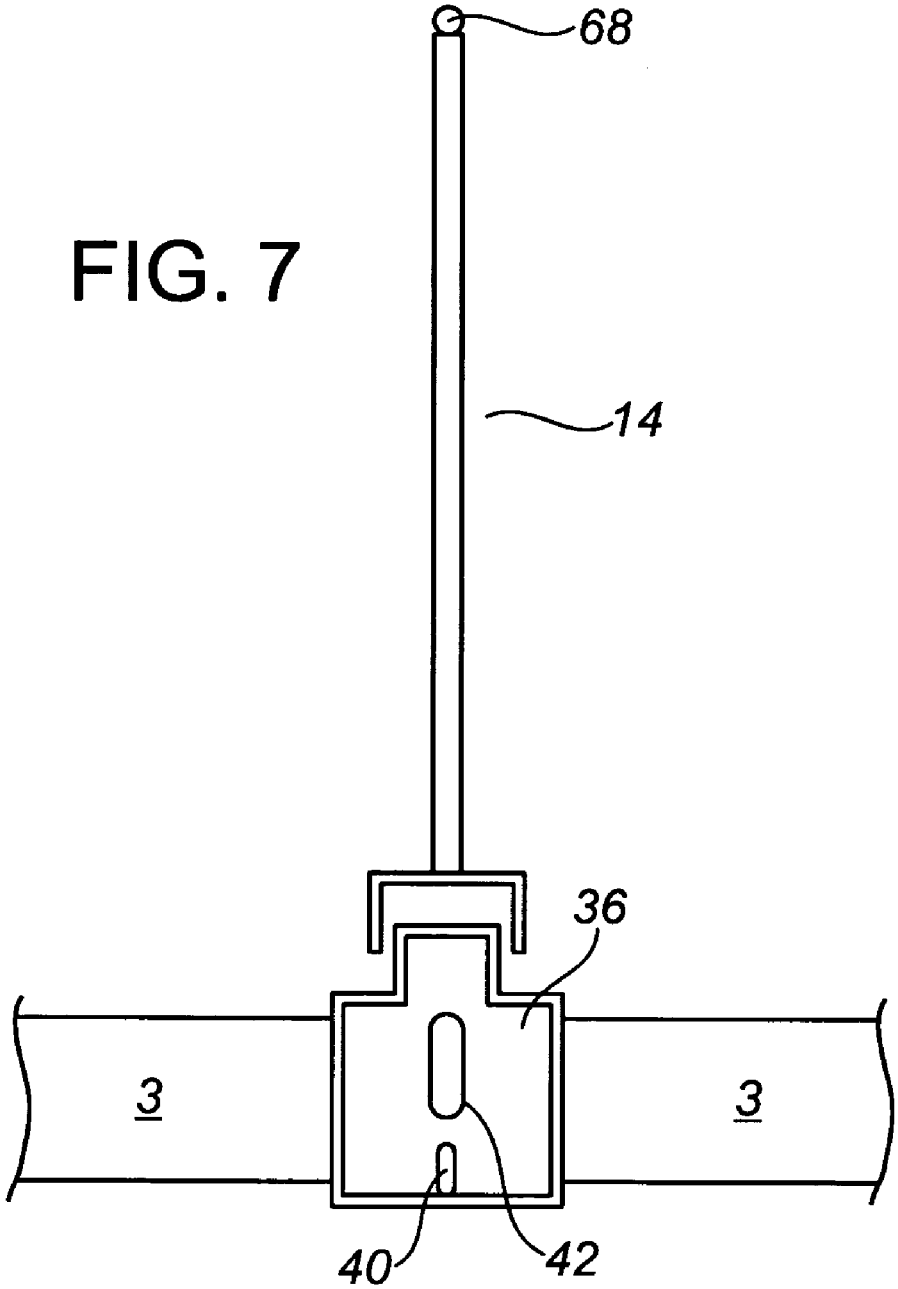
FIG. 7 is a diagrammatic representation of a top view of a scaffolding apparatus of one embodiment of the present invention, showing the detail of the second bracket member and bracing ring mounted on the top surface of a wall.

One screw clevis (72) is attached to the bracing ring (40) of the second bracket member (22). The other screw clevis (72) is anchored to the floor (5) using a standard floor bracket (82) having apertures (84, 86) through which suitable connectors such as, for example, screws and bolts (88), may extend to secure the brace (16) to the floor (5) (FIGS. 2 and 6). The floor bracket (82) can be formed of any suitable material including, for example, metals such as aluminum or steel. In one embodiment, one brace (16) is used, for example, with a wall which has a height ranging from eight to ten feet. In one embodiment, at least two braces (16) are included to provide additional support for a wall which has a height greater than ten feet. Multiple braces (16) may be joined together by suitable connectors including, for example, middle devises and threaded rods.

It will be appreciated by those skilled in the art that the rings (40, 60 and 68) can be formed of any suitable material, although for strength, the rings may be formed of forged steel, hardened steel, stainless steel, carbon, alloy and the like. The rings (40, 60 and 68) may be quenched and tempered to withstand cold and adverse outdoor conditions. Quenching and tempering maximizes the properties of the rings (40, 60 and 68) including, for example, its rated strength, durability, toughness, impact strength and fatigue resistance. Similarly, it will be appreciated by those skilled in the art that the described connectors (for example, bolts, nuts and screws) can be formed of like materials and may be rated, quenched or tempered to avoid weakening or bending when in use.

As shown in the Figures, each component is molded or fabricated as a separate part. However, those skilled in the art will understand that various modifications can be made without altering the substance of the invention. For example, each of the rings (40, 60 and 68) can be manufactured either as an integral component of the respective part or as a separate component to be attached to the part by welding or other standard techniques known in the art.

The above described invention provides several advantages. Notably, the vertical frame members (12) and associated support brackets (14) may be selectively attached and detached from the attachment brackets (10) which remain mounted on the top surface (3) of the wall (2). The scaffolding apparatus (1) can be conveniently installed at any time to permit work on the roof of the building. This arrangement is contrary to conventional designs wherein components used in construction are rarely permanently installed.

Figure 5:
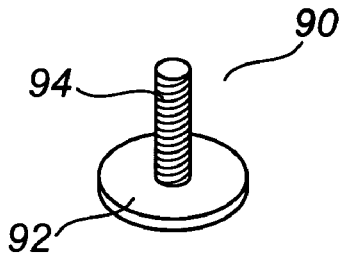
FIG. 5 is a diagrammatic representation of a perspective view of a plug of one embodiment of the present invention.

The attachment brackets (10) are positioned just above the soffit (i.e., the material forming a ceiling from the top of an exterior house or building wall to the outer edge of the roof to bridge the gap between a home's or building's siding and the roofline). When the vertical frame members (12) and support brackets (14) have been removed and the soffit has been installed, a passageway may be made in the soffit to allow access to the attachment brackets (10). The vertical frame members (12) and the support brackets (14) can thus be re-attached through the soffit to the attachment brackets (10) after the house or building has been constructed. A plug (90) having a head (92) and threaded neck (94) can be loaded into the threaded aperture (32) to cover the passageway when the suspended scaffold apparatus (1) is not in use (FIG. 5). It will be appreciated by those skilled in the art that the plug (90) can also be modified in shape to be loaded into the elongate slot (33) for the same purpose. In one embodiment, the plug (90) is formed of plastic. In one embodiment, the plug (90) is formed of a material which matches the color of the soffit.

The suspended scaffolding apparatus is suitable for use in both residential and commercial buildings, featuring safety and fall protection by inclusion of rail posts and harness rings. Further, the scaffolding apparatus allows the workman to adjust both the height and extension distance of the scaffold platform so that work functions can be readily and safely performed. The scaffolding apparatus is constructed of durable materials which can withstand weight and outdoor environments.

As will be apparent to those skilled in the art, various modifications, adaptations and variations of the foregoing specific disclosure can be made without departing from the scope of the invention claimed herein.

What is claimed is:

1. A suspended scaffolding apparatus for use on a wall, the wall having a substantially horizontal top surface and two sides, each such side comprising a substantially vertical face, the scaffolding apparatus comprising:

(a) at least two attachment brackets securely mountable to the top surface of the wall, wherein each attachment bracket comprises:

(i) a first bracket member comprising:

(A) a horizontal top plate, the top plate being securely mountable to the top surface of the wall;

(B) an interconnected first vertical plate extending in a direction down and away from the top of the wall in an orientation that is perpendicular to the horizontal top plate, the first vertical plate resting against one side of the wall in a substantially parallel manner; and either (C) the horizontal top plate extending in a direction out and away from the side of the wall and having a first attachment to releasably attach a vertical frame member; or (D) the first vertical plate having a substantially perpendicular horizontal base extending in a direction out and away from the side of the wall that the first vertical plate rests against, the horizontal base having a second attachment to releasably attach a vertical frame member, (E) wherein either the first or second attachment comprises an elongate slot in the horizontal top plate or the horizontal base of the first bracket member that complements a T-hook on one end of the vertical frame member;

(ii) a second bracket member comprising:

(A) a horizontal top plate, the top plate being adjustably mountable on the top plate of the first bracket member;

(B) an interconnected second vertical plate, the second vertical plate extending in a direction down and away from the top of the wall in an orientation that is perpendicular to the horizontal top plate, the second vertical plate resting against the side of the wall opposite to the first vertical plate in a substantially parallel manner; and (iii) a third attachment for a brace;

(b) at least two vertical frame members, each such vertical frame member being adapted to releasably attach to the first bracket member such that when it is attached to the first bracket member, the vertical frame member extends downwards in an orientation that is substantially perpendicular to the top surface of the wall and substantially parallel to the face of the wall; and (c) at least two support brackets, each such support bracket having attachment elements to releasably attach to a vertical frame member such that when attached, the support bracket extends in a direction that is out and away from the face of the wall in an orientation that is substantially perpendicular to the vertical frame member and each such support bracket having a detachable railing post extending upwards in an orientation that is substantially parallel to the vertical frame member;

whereby the vertical frame members and associated support brackets may be selectively attached and detached from the attachment brackets.

2. The scaffolding apparatus of claim 1 wherein the attachment brackets are adjustable to accommodate use of the apparatus with walls of differing sizes.

3. The scaffolding apparatus of claim 1, wherein each attachment bracket is adapted to releasably engage an elongate brace which extends between the attachment bracket and a supporting position.

4. The scaffolding apparatus of claim 3 wherein the brace is located on the side of the wall opposite to the vertical frame members and the associated support brackets.

5. The scaffolding apparatus of claim 1, wherein the top plate of the first bracket member has a plurality of apertures for the insertion of connectors for mounting the first bracket member on the top of the wall.

6. The scaffolding apparatus of claim 1 wherein the first attachment to releasably engage the vertical frame member comprises a threaded aperture in the horizontal top plate or the horizontal base of the first bracket member that complements a threaded projection on one end of the vertical frame member.

7. The scaffolding apparatus of claim 5, wherein the top plate of the second bracket member has a slot formed therein and is mounted to the top plate of the first bracket member by connectors extending through the slot to align with the apertures of the top plate of the first bracket member.

8. The scaffolding apparatus of claim 1, wherein the third attachment for a brace comprises a bracing ring fixed to the top plate of the second bracket member.

9. The scaffolding apparatus of claim 1, wherein the vertical frame member comprises an elongate body having a plurality of openings for the attachment of a support bracket to the vertical frame member, a threaded projection at one end to releasably engage a threaded aperture in the attachment bracket or a T-hook at one end to releasably engage an elongate slot in the attachment bracket, and a spacer member extending outwardly in a substantially perpendicular orientation at the opposite end.

10. The scaffolding apparatus of claim 1, wherein the support bracket comprises a quadrilateral frame having at least two opposing frame portions and two opposing end portions, the opposing frame portions being connected by one or more crossbeams oriented parallel to the opposing end portions.

11. The scaffolding apparatus of claim 10, wherein the first opposing end portion defines a plurality of bores through which connectors extend to align with the openings of the vertical frame member to releasably attach the support bracket to the vertical frame member.

12. The scaffolding apparatus of claim 10, wherein the second opposing end portion provides connectors to releasably attach the railing post to the support bracket.

13. The scaffolding apparatus of claim 12, wherein the connector comprises a tapered pin.

14. The scaffolding apparatus of claim 10, further comprising a harness ring attached to the support bracket for threading of securing members.

15. The scaffolding apparatus of claim 1, wherein the railing post supports railing brackets for retaining boards and a harness ring for threading of securing members.

16. The scaffolding apparatus of claim 8, wherein the brace comprises an elongated body having a screw clevis at each end, one screw clevis being attached to the bracing ring of the second bracket member, and the other screw clevis being anchored to the floor by a floor bracket.

17. The scaffolding apparatus of claim 6, further comprising a plug having a head and threaded neck for attachment to the threaded aperture, or a plug complementary for attachment to the elongate slot when the apparatus is not in use.

* * * * *